United States Patent [19]

Housman

[11] 4,232,799

[45] Nov. 11, 1980

[54] LOW PROFILE DISPLAY

[76] Inventor: Richard W. Housman, 3416 Manning Ave., Los Angeles, Calif. 90064

[21] Appl. No.: 894,228

[22] Filed: Apr. 7, 1978

[51] Int. Cl.[3] ..... B65D 85/20

[52] U.S. Cl. ..... 221/92; 206/443; 221/155; 221/285; 248/174; 229/22

[58] Field of Search ..... 221/69, 92, 98, 155, 221/285, 305, 307, 309; 229/22; 248/174; 206/0.81, 366, 367, 369, 370, 379, 443, 451, 472, 554; 211/133

[56] References Cited

U.S. PATENT DOCUMENTS

| | | | |
|---|---|---|---|
| 1,613,529 | 1/1927 | Payne | 221/92 |
| 1,628,439 | 5/1927 | Staubly | 221/307 |
| 1,898,646 | 2/1933 | Taylor | 221/307 X |
| 1,940,909 | 12/1933 | Hermani | 221/285 |
| 2,235,046 | 3/1941 | Rosenbluth | 221/92 |
| 2,861,171 | 11/1958 | Adler | 221/309 X |
| 3,114,452 | 12/1963 | Bondy | 206/0.81 |

FOREIGN PATENT DOCUMENTS

| | | | |
|---|---|---|---|
| 1222240 | 6/1960 | France | 206/379 |

*Primary Examiner*—F. J. Bartuska
*Attorney, Agent, or Firm*—Robert Berliner

[57] ABSTRACT

A vending device comprising a box-like housing subdivided in its interior by partitions which form an array of storage bins. A cover, releasably secured to the device, is formed with flexible, resilient projections, each projection partially covering a bin, permitting an article of merchandise therein to be withdrawn by upward flexure of the projection thereat. In one form of the invention the housing is retained on a stand therefor at an angle of about 45°. In another form of the embodiment, the housing is retained adjacent a change tray.

19 Claims, 10 Drawing Figures

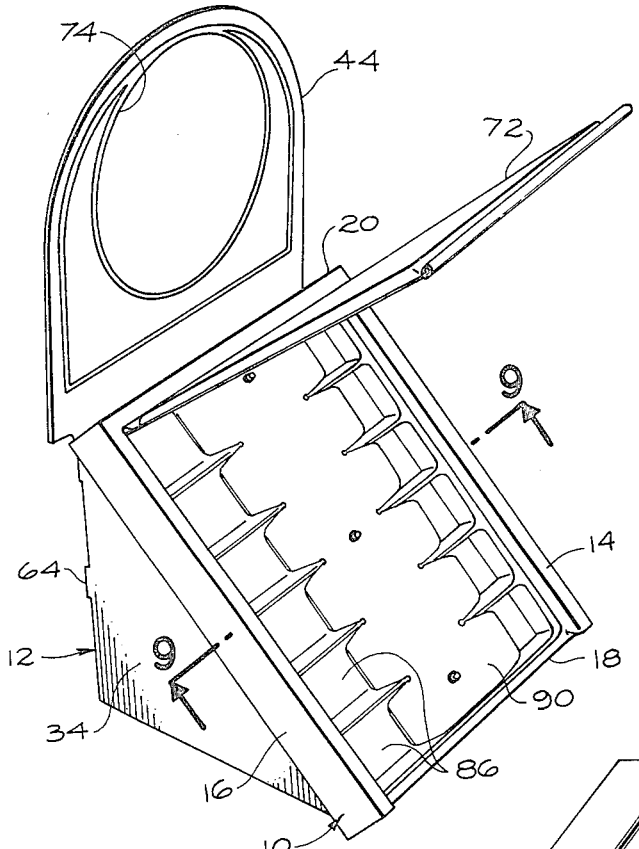
FIG. 1.
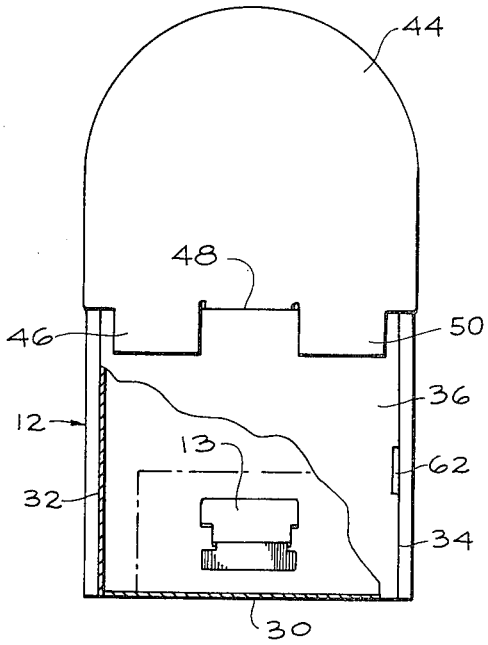
FIG. 2.
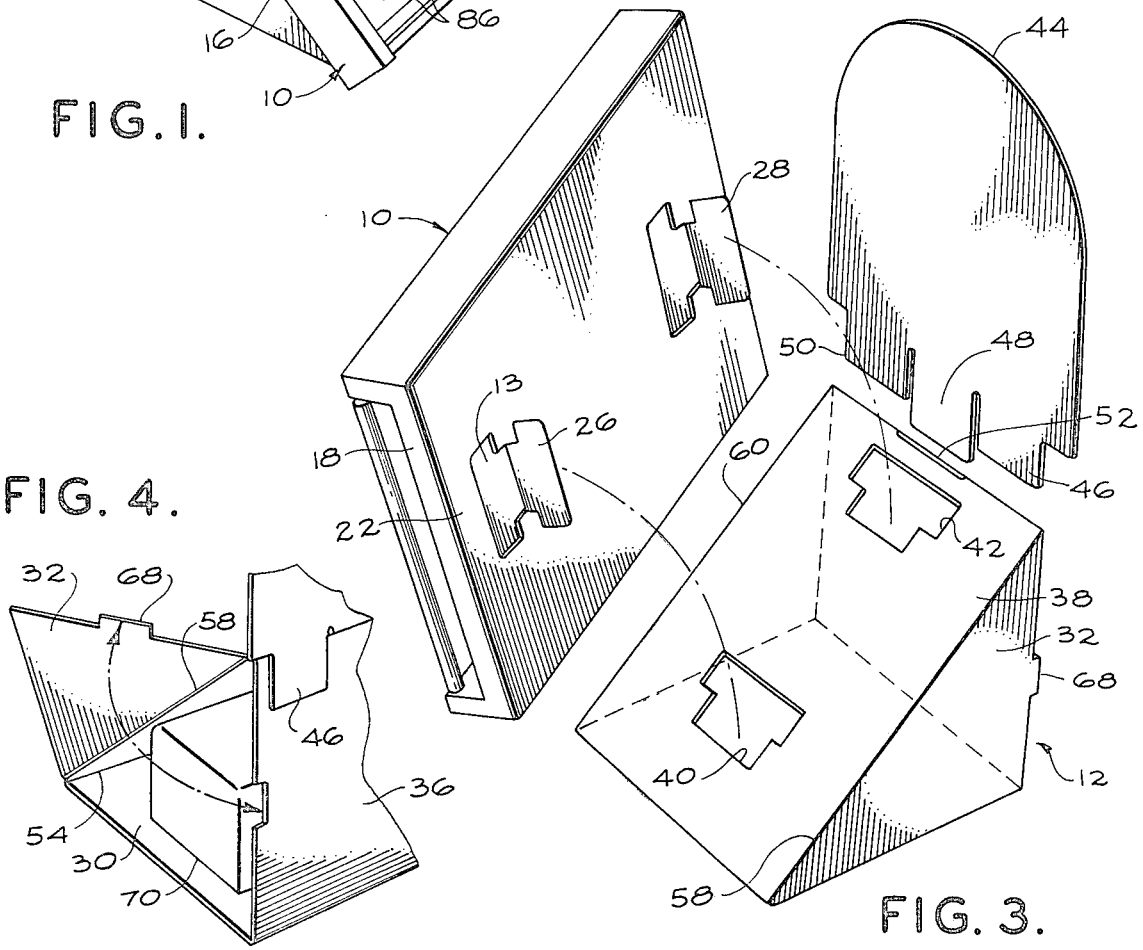
FIG. 4.
FIG. 3.

LOW PROFILE DISPLAY

FIELD OF THE INVENTION

The field of art to which the invention pertains includes the field of merchandise vending devices, wherein items of merchandise are stored for selective-type vending.

BACKGROUND AND SUMMARY OF THE INVENTION

In the vending of certain types of merchandise it is often desirable to display the items on retail counters, at the point of pruchase near the cash register. It is also desirable to be able to store different units of merchandise in bulk, yet permit a selection therefrom. An example which is particularly pertinent to the present invention is the storage and vending of astrological reports or horoscopes in the form of cylindrical scrolls of spirally wound sheets. A separate and distinctive report is provided for each of the twelve astrological signs, but all of the reports have identical shape. Other examples include similarly packaged lipsticks of different shades or colors, or other sundry goods in generally similar containers. In each case it is necessary to store a quantity of such goods, provide means for viewing the goods, and means for selecting one type over another, all with a mechanism of sufficient reliability, ease of loading and use, compactness and low cost, to be commercially attractive and to permit usage on retail counters where space is at a premium. Particularly with regard to horoscope reports, where such reports are published monthly, it is desirable to also be able to store a supply of the next month's reports close at hand.

The present invention satisfies the foregoing needs by providing a vending device with a plurality of storage bins, wherein a bin can be selected as desired, but wherein the items of merchandise in each bin are randomly selected. The vending device includes an array of bins in which items of merchandise are stored in bulk with different items in different bins. All of the bins can be readily loaded in one operation and thereafter can be simultaneously viewed, so that a full range of the available selection can be seen. The present construction provides bins with large storage capacity in a minimum of space, permitting the vending devices to be located on counter tops to facilitate point of purchase sales. In a particular embodiment, a stand is provided for the vending device which disposes the device at the convenient angle of about 45° and also provides storage space for additional supply of the goods. In another particular embodiment, the device cooperates with a coin changer so that it attracts point-of-sale purchases.

The storage device includes an array of bins formed by a combination of upright walls provided in a box-like housing. A thin, flat cover member of flexible, resilient material is secured to the top edge of a wall running along the longitudinal axis of the device and extends as a cover partially overlying each of the bins. The cover member comprises an elongate base region and a plurality of projections integral therewith and extending from a side of the base region. At least one projection extends partially over each of the bins, permitting merchandise to be withdrawn from a bin by upward flexure of the projection. The base region of the cover member is releasably secured to the wall edge by means of snap fasteners of which the male and female components are affixed confrontingly through the undersurface of the base region of the cover member and to the top edge of the wall, permitting repeated connections and separations of the respective members. In a specific embodiment, a plurality of identically shaped projections are symmetrically disposed on each side of the base region of the cover member and the wall is disposed medially, thereby defining a centerline of symmetry of the device. The projections correspond in number to the number of bins and are spaced so that each projection overlies a predetermined portion of one bin when the cover member is aligned in a predetermined orientation.

The projections, or the entire cover member may be translucent or decorated, or may be opaque. A sufficiently extended portion of the bin is not covered by a projection so that a view of the stored articles is permitted, but the exposed region is small enough to prevent articles from freely sliding or rolling out of the bin when the device is jolted or tilted. To reload the bins the cover member can be removed, uncovering the bins.

BRIEF DESCRIPTION OF THE DRAWINGS

FIG. 1 is a perspective view of a vending device supported on a stand in accordance with the present invention;

FIG. 2 is a rear elevational view of the device and stand of FIG. 1, partially broken away to show a retaining tab;

FIG. 3 is a perspective partially exploded view of the opposite side of the device of FIG. 1;

FIG. 4 is a perspective view of a portion of the device of FIG. 1 from the orientation of FIG. 3, illustrating opening of a compartment in the stand;

DETAILED DESCRIPTION

Figure 6:
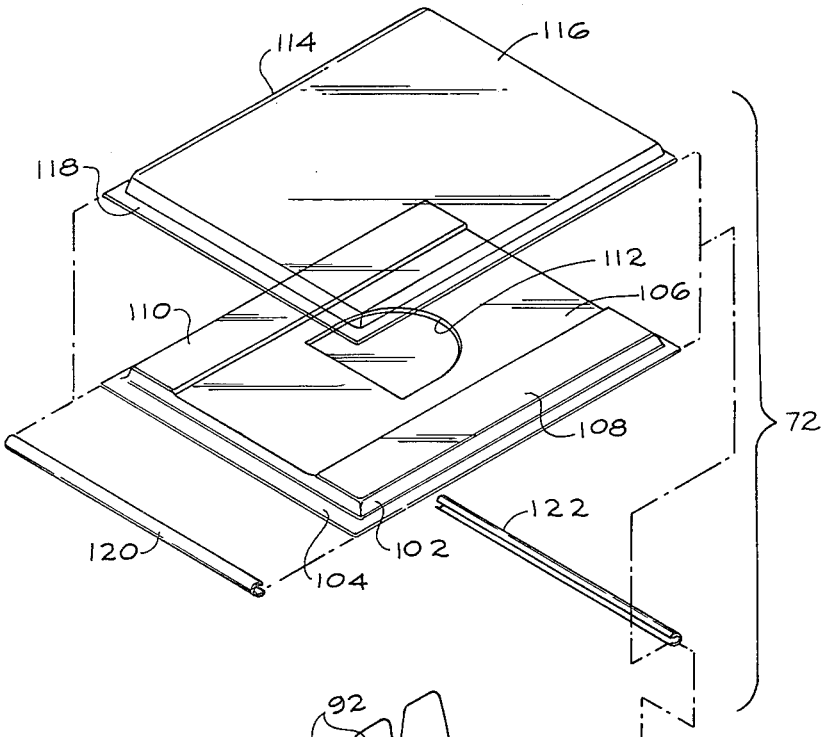
FIG. 6 is a cross-sectional view taken on line 6—6 of FIG. 5, in the direction of the arrows.
Figure 6:
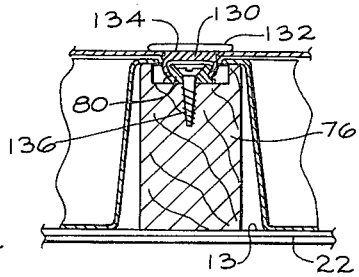
Figure 7:
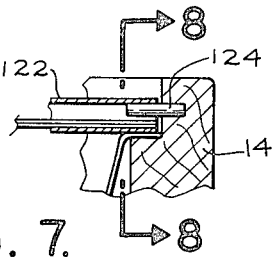
FIG. 7 is a cross-sectional view taken on line 7—7 of FIG. 5, in the direction of the arrows.

Referring to FIGS. 1-4, there is provided a vending device 10 supported on a stand 12. The vending device 10 will be described in more detail hereinafter and includes a substantially rectangular open housing which is formed by a bottom wall 13 a pair of upright parallel side walls 14 and 16, and a pair of upright parallel end walls 18 and 20. A thin layer 22 of cardboard is adhesively secured by its edges to the bottom wall 13 and is formed with a spaced pair of cutout tabs 26 and 28.

The stand 12 is formed with a botton wall 30, side walls 32 and 34, a rear wall 36 and a sloping top wall 38 defining a hollow triangular structure. The sloping wall 38 is formed with a pair of spaced openings 40 and 42 shaped to receive the tabs 26 and 28, respectively, so as to securely retain the vending device 10. An upright placard 44 is formed with a plurality of dependent tabs 46, 48 and 50 along its bottom edge, the middle tab 48 extending through a slot 52 formed therefor along the upper edge of the sloping wall 38, on the inside of the rear wall 36 while the adjacent tabs 46 and 50 extend along the top part of the outer side of the rear wall 36.

The sloping top wall 38 and rear wall 36 are hingedly secured at 54 and 56, respectively, to the bottom wall 30. The side walls 32 and 34 are pivotally secured at 58 and 60, respectively, to the sloping wall 38. In this regard, the stand 12 other than the upright placard 44 can be formed from one piece of cardboard with lines of weakness defining the hinges. The rear wall 36 is formed along its sides edges with slots 62 and 64 which matingly engage with tabs 66 and 68, respectively (see FIG. 4), so as to secure the side walls 32 and 34 to the rear wall 36, defining an internal compartment in the stand. As shown in FIG. 4, by pivoting the side wall 32 or 34 upwardly, as shown by the arrow, access can be had to the compartment and is a convenient place to store supplies for the vending device. In the form illustrated, the device is used to display horoscope reports and a box 70 of such reports for the upcoming month can be readily stored in the compartment.

Use of the device can be readily seen from FIG. 1. The vending device is formed with a plurality of bins containing merchandise and a lid 72 is pivotable with respect to the top of the device so as to close the device when not in use. The lid includes transparent portions through which the articles of merchandise can be viewed. Accordingly, by disposing the device on the stand at the sloped disposition, an angle of about 45°, a customer can readily view the contents through the lid 72, lift the lid 72 and select a desired article of merchandise. The upright placard 44 can contain advertising material, for example located in a depressed portion 74.

In FIGS. 5–9 there is shown details of construction of the vending device. An upright wall 76 is disposed medially on the bottom wall 13 running along the longitudinal axis of the device 10 from one end wall 18 to the other end wall 20. A tray 78, molded from organic polymer material, is formed to be received on the bottom wall 13, straddling the medial wall 76. A plurality of female fastener snap components 80 are secured to the top edge of the medial wall 76 and correspondingly disposed openings 82 therefor are formed through a flat medial portion 84 of the tray 78. The tray 78 is formed with a plurality of bins 86 defined by divider walls 88 symmetrically on opposite sides of the medial tray portion 84. A cover member 90 of substantially rectangular form covers a portion of the array of open top bins 86. The cover member 90 is preferably made of thin, flexible resilient material such as from a thin sheet of plastic, metal or the like, is symmetrical about a centerline and has substantially the same length as that of the tray 78. On both sides of the cover member 90 and equidistantly from its centerline of symmetry, a plurality of identically shaped projections 92 extend from a central base region 94 outwardly in the plane of the cover member. The width of the cover member, measured between the opposite ends of the projections 92, is less than the width of the array of bins 86, i.e., less than the distance between the side walls 14 and 16. The projections 92 are generally trapezoidal shape defined by triangular reliefs formed with apices into the outer edges of the cover member 90 so that the projections taper somewhat toward their outer ends. Their number is proportional to the number of bins 86 in the array. When the centerline of the cover member 90 is aligned with the flat medial portion 84 of the tray 78, i.e., so that the openings 82 overlie the snap fastener components, each of the projections 92 is positioned so as to overlie a predetermined portion of one of the bins 86.

Figure 9:
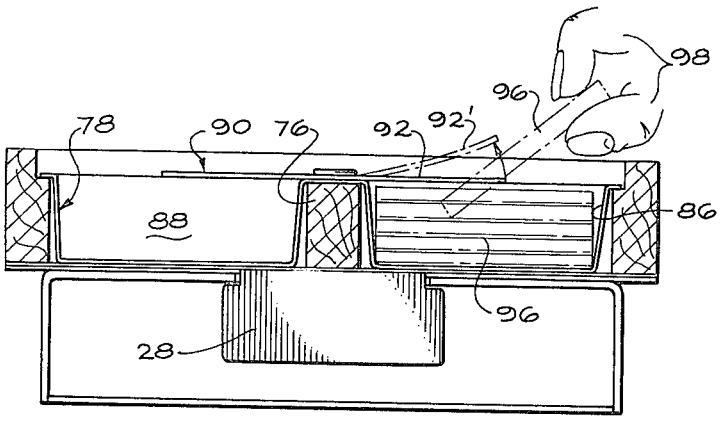
FIG. 9 is a cross-sectional view taken on line 9—9 of FIG. 1, in the direction of the arrows, and illustrating operation of the device.

In a specific embodiment, illustrated most clearly in FIG. 9, the partial cover provided by each of the projections 92 is sufficient to prevent the accidental egress of articles from the bins 86. The portion of each bin 86 which is not covered, permits a view of the articles 96 that are stored therein and provides a means for manual access to withdraw one or more of the selected articles 96. The outer ends of the projections 92 may be flexed upwardly to temporarily widen the access space and to facilitate the removal of the articles 96 from the bins 86 as shown by the fingers 98 and upward shadow position of the projection 92'. In this embodiment, the articles illustrated are astrological reports of horoscopes in the form of cylindrical scrolls of elongate sheets spirally wound into a shape somewhat shorter and thicker than a cigarette.

Figure 5:
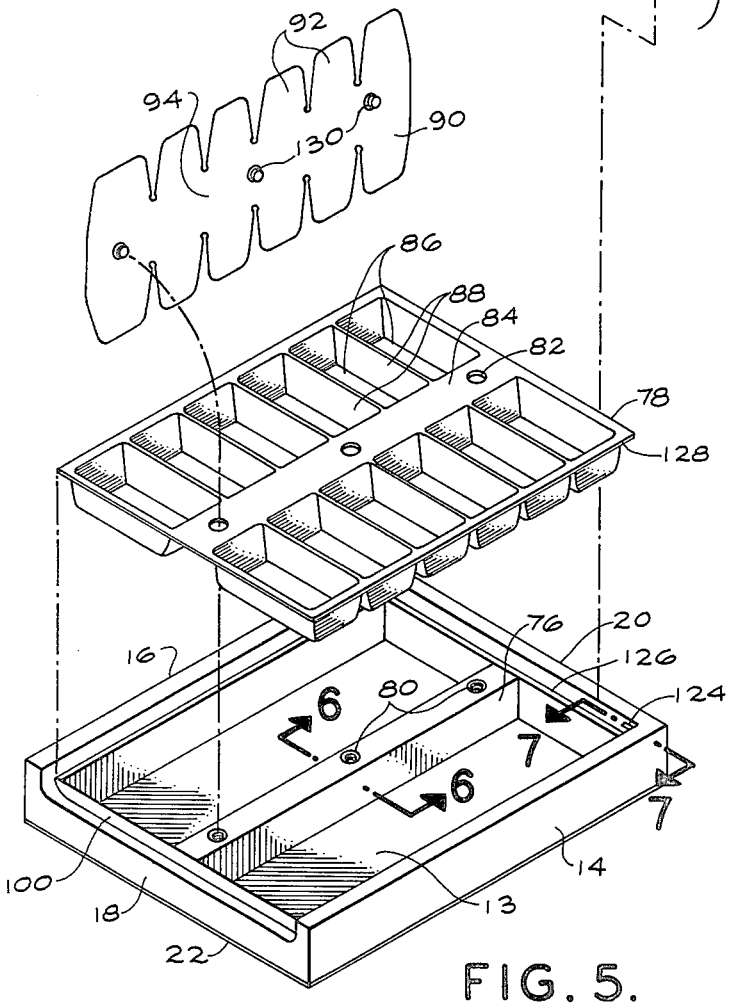
FIG. 5 is a perspective exploded view of the vending device component of FIG. 1.

Referring both to FIGS. 5 and 9, there are 12 bins 86, one for each sign of the zodiac. Each bin 86 has a depth dimension which is substantially the height of the medial wall 76 so that when the tray 78 is draped over the medial wall 76 the bottom of the bins 86 rests upon the bottom wall 13 of the vending device. As shown more particularly in FIG. 5, one of the end walls 18 defines a longitudinal cut-out portion 100 along its upper edge, contoured to permit insertion of one's fingers beneath the lid 72. The height of the end wall 18 approximates that of the medial wall 76. Accordingly, the side walls 14 and 16 extend above the medial wall 76 and therefore also above the top of the bins 86 and cover member 90, a distance sufficient to accommodate the lid 72 flush with, or somewhat below, the top edges of the side walls 14 and 16.

The lid 72 is an assembly of components shown in exploded view in FIG. 5. The lid 72 comprises a support member 102 formed of rigid plastic material and contoured to provide an outer ledge 104, a medial display region 106 and adjacent shoulder portions 108 and 110. The display region 106 is further contoured to an extended semicircular indentation 112 to accommodate graphic material of that shape. The medial display region 106 is preferably opaque, with a design as desired. The shoulder portions 108 and 110 are preferably transparent so that a customer can view at least partially the contents of the bins 86 through the shoulder portions. In this regard, the cover member 92 has a width dimension approximating that of the opaque medial display region 106, so that it is hidden by the display region when the lid is in place. A cover 114 for the lid 72 is provided which is transparent and which has a substantially flat top surface 116. The cover 114 is contoured to a tray shape with outer ledges 118 coterminous with the outer ledge 104 of the support member. The lid cover and support member are secured together by means of elongate C-shaped channels 120 and 122 applied to the opposite ends of the lid.

Figure 8:
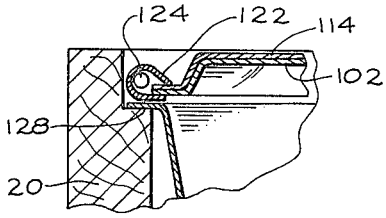
FIG. 8 is a cross-sectional view taken on line 8—8 of FIG. 7, in the direction of the arrows.

In assembling the vending device, the lid 72 is pivotally secured by rotating the rear channel 122 onto a pair of hinge pins, such as at 124 in FIG. 5, and which are shown in more detail in FIG. 8. The side walls 14 and 16 and rear end wall 20 are formed with a shoulder 126 spaced downwardly from the top edges of the walls so that its top surface is flush with the top surface of the medial wall 76. The bin tray 78 is formed with a peripheral shoulder 128 coterminous with the aforedescribed shoulder 126. By such means, the bin tray 78 is secured between the rear channel 122 and shoulder 128 portion thereat. Lifting of the lid 72 pivots the channel 122 on the hinge pin 124.

As previously described, female snap fastener components 80 are secured to the upper surface of the medial wall 76 and extend through the openings 82 therefor in the medial tray portion 84. Referring additionally to FIG. 6, a corresponding plurality of male snap fastener components 130, having a decorative outer button surface 132 are press fit through openings 134 therefor in the cover member 90 so as to be coincident with the female snap fastener components 80. As shown, the female snap fastener components 80 are each secured by means of a screw 136, driven through the components into the medial wall 76. In this regard, the snap fasteners are disposed along the centerline of symmetry of the vending device. Engagement of the male and female components of the snap fasteners produces a tight bond between the cover member 90 and the medial wall 76. The cover member 90 may be disengaged in part or in its entirety from the medial wall 76 to uncover all or a predetermined number of bins 86 for reloading in one easy operation. Engagement and disengagement of the cover member 90 may be repeated as often as desired. Referring additionally to FIGS. 1 and 4, by simply opening the side walls 32, one can retrieve a fresh supply 70 of articles 96. The cover member 90 can then be lifted and the fresh articles loaded very easily into the appropriate bins 86.

Figure 10:
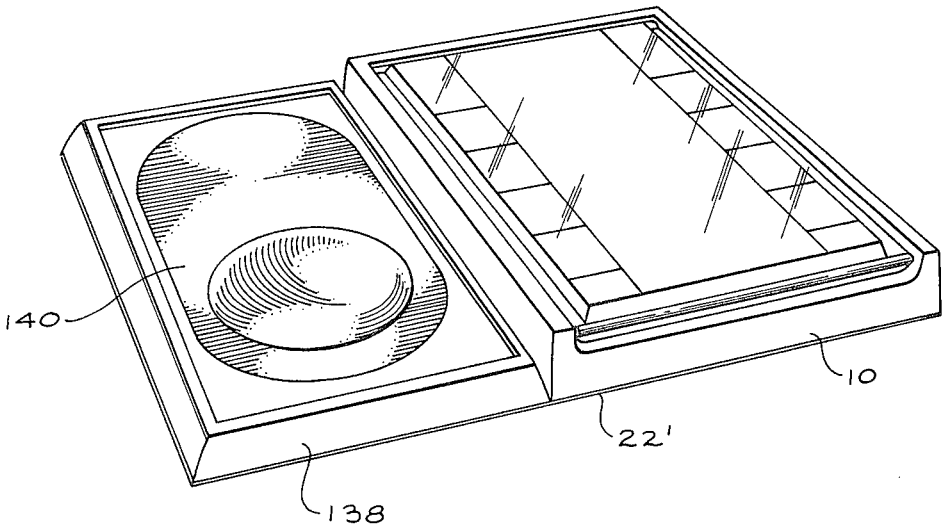
FIG. 10 is a perspective view of another embodiment of the invention in which the vending device is incorporated with a change tray.

Referring now to FIG. 10, an alternative embodiment is disclosed incorporating a vending device 10 which is identical to the device 10 illustrated in FIG. 5, except that it is carried on a support sheet of cardboard 22' which extends laterally a distance sufficient to support a change tray 138. The change tray 138 extends along the side of the vending device 10 and is formed with dished out portions 140 serving to hold small change. The change tray 138 is secured by adhesive to the supporting cardboard layer 22' so as to constitute a unitary structure with the vending device 10. The embodiment of FIG. 10 is very useful for point of sale display.

I claim:

1. A vending device for the storage and display of articles of merchandise, comprising:

a housing having a plurality of vertical walls, one of said walls extending longitudinally centrally of said housing, partitioning said housing into two substantially equal portions;

an array of bins, each bin for containing a plurality of articles of merchandise;

a cover member of flexible, resilient material symmetrical about a centerline of symmetry of a base region thereof and having a plurality of substantially trapezoidal projections formed integrally with said base region, extending and tapering outwardly from each side of said base region, a single one of said projections extending over a portion only of each of said bins whereby to permit an article of merchandise to be withdrawn from a bin by upward flexure of said projection thereover relative to said base region;

interengagable components on the top edge of said centrally extending wall and on a confronting surface of said cover member; and a lid hingedly connected to said housing for closing over said cover members to enclose said bins, said lid being substantially opaque along a region sufficient to substantially block viewing of said cover member when said lid is closed, but being sufficiently clear along edge regions to permit viewing of articles of merchandise in said bins.

2. A vending device for the storage and display of articles of merchandise, comprising:

a housing having a plurality of vertical walls, one of said vertical walls extending longitudinally centrally of said housing, partitioning said housing into two substantially equal portions;

an array of bins in said housing, each bin for containing a plurality of articles of merchandise; and a cover member comprising a base region and a plurality of projections extending outwardly from each side of said base region, said cover member being symmetrical about a centerline of symmetry of said base region and secured to the top edge of said centrally extending wall along said centerline of symmetry for partially overlying each of said bins, and at least one of said projections extending over a portion only of each of said bins, whereby to permit an article of merchandise to be withdrawn from a bin by upward movement of said projection thereover relative to said base region.

3. The device of claim 2 including a lid hingedly connected to said housing for closing over said cover member to enclose said bins, said lid being substantially opaque along a central region sufficient to substantially block viewing of said cover member when said lid is closed, but being sufficiently clear along edge regions to permit viewing of articles of merchandise in said bins.

4. A vending device for the storage and display of articles of merchandise, comprising in combination:

a housing for containing a plurality of articles of merchandise; and a stand formed to support said housing at an oblique angle, said stand comprising a plurality of hingedly connected walls defining an internal compartment, including a bottom wall, a rear wall hingedly connected to the bottom wall, an obliquely disposed top wall and a pair of side walls, at least one side wall being hingedly connected to said top wall to provide access to said internal compartment.

5. A vending device for the storage and display of articles of merchandise, comprising:

at least one vertical wall extending longitudinally centrally of said device, partitioning said device into two portions;

an array of bins disposed on each side of said centrally extending wall, each bin being formed to contain a plurality of articles of merchandise side by side; and a cover member comprising a base region and a plurality of projections extending outwardly from each side of said base region, said cover member being symmetrical about a centerline of symmetry of said base region and secured to the top edge of said centrally extending wall along said centerline of symmetry for partially overlying each of said bins whereby to expose in each bin plural articles of said merchandise, and at least one of said projections extending over a portion only of each of said bins, whereby to permit an article of merchandise to be withdrawn from a bin by upward movement of said projection thereover relative to said base region.

6. The device of claim 5 in which said cover member projections are of flexible, resilient material extending from said base region for flexure upon said upward movement.

7. The device of claim 6 in which said base region and projections are integrally formed of said flexible, resilient material.

8. The device of claim 5 including interengagable components on confronting surfaces of said cover member and said top wall edge.

9. The device of claim 8 in which said interengagable components comprise male and female snap fastener components.

10. Vending means for the storage and display of articles of merchandise, comprising:

at least one vertical wall extending along a first dimension;

a row of bins disposed on each side of said vertical wall arrayed along said first dimension, each bin being formed to contain a plurality of articles of merchandise side by side;

means for partially covering said bins whereby to expose in each bin plural articles of said merchandise, comprising base regions along said first dimension one each extending on each side of a said vertical wall secured along said first dimension, and a plurality of projections extending outwardly from each base region, each projection extending over a portion only a respective bin whereby to permit an article of merchandise to be withdrawn from a bin by upward movement of said projection thereover relative to the respective base region.

11. The vending means of claim 10 in which said base regions are joined to constitute a single base region symmetrical about a centerline of symmetry and wherein securement of said single base is to the top of said vertical wall.

12. The vending means of claim 11 in which said securement is by means of interengageable components on the confronting surfaces of said single base and the top of said vertical wall.

13. The device of any of claims 2, 5, 6 or 7 in which said projections are of generally trapezoidal shape tapering toward their outer ends.

14. The device of any of claims 2, 5, 6 or 7 including a lid for said housing for closing over said cover member to enclose said bins.

15. The device of any of claims 2, 5, 3, 6 or 7 in combination with a stand separable from said device, said stand comprising a plurality of hingedly connected walls including a bottom wall, a rear wall, an obliquely disposed top wall and a pair of side walls, said device including at least one flexible tab extending from the bottom of said device, the top wall of said stand defining an opening for receipt of said tab whereby to secure said device to said stand at an oblique angle.

16. The device of any of claims 2, 5, 3, 6 or 7 in combination with a stand formed to support said device at an oblique angle, said stand comprising a plurality of hingedly connected walls defining an internal compartment, including a bottom wall, a rear wall hingedly connected to said bottom wall, an obliquely disposed top wall and a pair of side walls, at least one side wall being hingedly connected to said top wall to provide access to said internal compartment.

17. The device of claim 16, in which said top wall is hingedly connected to said bottom wall.

18. The device of any of claims 2, 5, 6 or 7 including a planar sheet as a support member secured to the bottom of said device and extending from one end of said device, and a coin tray secured to said support member adjacent said device.

19. The device of claim 18 including a lid secured to pivot upwardly from one end of said device along a predetermined dimension of said device, said coin tray being secured along said dimension.

* * * * *